US009216516B2

(12) United States Patent
Rees et al.

(10) Patent No.: US 9,216,516 B2
(45) Date of Patent: Dec. 22, 2015

(54) RAZOR HANDLE HAVING A RETRACTABLE RAZOR HEAD CARRIER AND A MOVABLE FLAP, AND RAZOR HAVING SUCH A HANDLE

(75) Inventors: Samuel Ryan Rees, Sheffield (GB); Ioannis Bozikis, Koukaki-Athens (GR); Dimitris Efthimiadis, Nea Kypseli-Athens (GR)

(73) Assignee: BIC-VIOLEX S.A., Anixi, Attiki (GR)

( * ) Notice: Subject to any disclaimer, the term of this patent is extended or adjusted under 35 U.S.C. 154(b) by 529 days.

(21) Appl. No.: 12/937,269

(22) PCT Filed: Apr. 11, 2008

(86) PCT No.: PCT/EP2008/054445

§ 371 (c)(1),
(2), (4) Date: Oct. 10, 2010

(87) PCT Pub. No.: WO2009/124600

PCT Pub. Date: Oct. 15, 2009

(65) Prior Publication Data

US 2011/0030228 A1 Feb. 10, 2011

(51) Int. Cl.

| | |
|---|---|
| ***B26B 21/52*** | (2006.01) |
| ***B26B 21/40*** | (2006.01) |
| *B26B 21/22* | (2006.01) |

(52) U.S. Cl.

CPC ..... *B26B 21/528* (2013.01); *B26B 21/40* (2013.01); *B26B 21/4062* (2013.01); *B26B 21/521* (2013.01); *B26B 21/523* (2013.01); *B26B 21/222* (2013.01); *B26B 21/4037* (2013.01)

(58) Field of Classification Search

CPC ..... B26B 21/4037; B26B 21/4062; B26B 21/528; B26B 21/523; B26B 19/382; B26B 19/3833; B26B 19/3853; B26B 19/3886

USPC ..... 30/34.05, 58, 60.5, 61, 62, 63, 64, 66, 30/526, 527, 535, 51; 83/397, 398

See application file for complete search history.

(56) References Cited

U.S. PATENT DOCUMENTS

| | | | | | |
|---|---|---|---|---|---|
| 2,691,216 | A | * | 10/1954 | Ross | 30/34.05 |
| 2,881,774 | A | * | 4/1959 | Labbe | 453/17 |
| 3,538,604 | A | * | 11/1970 | Spencer et al. | 30/34.05 |
| 3,760,498 | A | * | 9/1973 | Shortlidge et al. | 30/43.1 |
| 3,997,967 | A | | 12/1976 | De Boer | |
| 4,077,161 | A | * | 3/1978 | Wyle et al. | 451/231 |
| 4,805,504 | A | * | 2/1989 | Fushiya et al. | 83/397 |
| 5,199,343 | A | * | 4/1993 | O'Banion | 83/397 |
| 5,203,245 | A | * | 4/1993 | Terpstra | 83/397 |
| 6,279,442 | B1 | * | 8/2001 | Chang | 83/397 |
| 6,755,107 | B2 | * | 6/2004 | Peot et al. | 83/478 |
| 6,782,625 | B1 | * | 8/2004 | Wong | 30/43.92 |
| 2005/0005752 | A1 | * | 1/2005 | Xin et al. | 83/397 |
| 2007/0180699 | A1 | | 8/2007 | Psimadas et al. | |

* cited by examiner

*Primary Examiner* — Kenneth E. Peterson
*Assistant Examiner* — Jennifer Swinney
(74) *Attorney, Agent, or Firm* — Jones Day

(57) ABSTRACT

A razor handle that includes an elongated hollow housing having an opening provided on the front end, a razor head carrier which is slidably mounted in the recess between a first non-shaving position in which the razor head carrier is retracted and completely located inside the recess, a second shaving position, and a sliding mechanism for moving the razor head carrier. The razor handle further includes a pivotally mounted movable flap having a closed position in which the flap closes the opening, and an open position in which the flap is fully open and gives way to the razor head carrier, the movable flap being driven by a linkage.

11 Claims, 8 Drawing Sheets

RAZOR HANDLE HAVING A RETRACTABLE RAZOR HEAD CARRIER AND A MOVABLE FLAP, AND RAZOR HAVING SUCH A HANDLE

CROSS-REFERENCE TO RELATED APPLICATION

This application is a national stage application of International Application No. PCT/EP2008/054445, filed on Apr. 11, 2008, the contents of the application being incorporated herein by reference.

FIELD OF THE INVENTION

The embodiments of the present invention relate to a razor handle having a retractable razor head carrier and a retractable cover, and a razor having such a handle.

BACKGROUND OF THE EMBODIMENTS OF THE PRESENT INVENTION

U.S. Pat. No. 3,997,967 discloses a razor assembly having a housing to receive a movable trimming device. This trimming device has a first retracted position corresponding to a non-shaving position and a second extended position, corresponding to a shaving position. The trimming device is actuated by a sliding mechanism operated by a knob. The trimming device also comprises a movable covering flap which closes the opening, the flap being biased to the closed position by a spring mechanism. In this embodiment, the razor head pushes the flap to the open position against the return action of the spring mechanism, and the contact between the razor head and the flap may cause damage to cutting blades.

SUMMARY OF THE EMBODIMENTS OF THE PRESENT INVENTION

More precisely, the embodiments of the present invention concerns a razor handle comprising a hollow elongate housing having a front end and a back end opposite to the front end, the housing further comprising an opening provided at the front end, a razor head carrier which is slidably mounted in the housing between a first, non-shaving position in which the razor head carrier is retracted inside the housing, and a second, shaving position in which the razor head carrier is extended towards the opening of the housing, a sliding mechanism provided on the housing for moving the razor head carrier between the first position and the second position, and a movable flap movably mounted between a closed position in which the flap closes the opening, and an open position in which the opening is open.

The way to open and close such a movable flap may be improved further, and it is an object of the embodiments of the present invention to avoid any contact between the razor head and the movable flap, thus preventing damage to the cutting blades.

To this end, the razor handle according to the embodiments of the present invention is characterized in that the movable flap is driven back and forth by the razor head carrier so that the movable flap is in the closed position when the razor head carrier is in the first position and the movable flap is in the open position when the razor head carrier is in the second position.

In various embodiments of the present invention, one and/or the other of the following features may be incorporated:

the movable flap is pivotally mounted around a swiveling axis, the housing preferably has two recesses defining the swiveling axis, and the movable flap having two protruding pins received respectively in the two axis recesses.

the razor handle further comprises a linkage, the movable flap is controlled by the linkage and the linkage is controlled by the razor head carrier;

the linkage is movable with the razor head carrier and the linkage is pivotally mounted on the movable flap;

the linkage comprises an elongated U-shaped wire having a center portion and two lateral arms, the movable flap having two symmetrically opposed holes receiving the respective ends of the arms;

the razor head carrier comprises a control profile, wherein the housing comprises at least one complementary control profile, the control profile and the complementary control profile cooperating with the linkage by pushing and pulling the linkage;

the control profile comprises a recess and the complementary control profile comprises a complementary recess, and the razor head carrier preferably has a stroke, comprising at least a first stroke portion in which the center portion of the linkage is located in the recess and driven by the razor head carrier, and a second stroke portion in which the center portion of the linkage is located in the complementary recess and is not moving relative to the housing;

along the first stroke portion, the recess receives the center portion of the linkage, and moves the center portion of the linkage along the complementary control profile, and along the second stroke portion, the complementary recess receives the center portion of the linkage, while the control profile slides and urges the center portion of the linkage in the complementary recess;

when the razor head carrier is moved from the first stroke portion to the second stroke portion, the center portion of the linkage is transferred from the recess to the complementary recess, and when the razor head carrier is moved from the second stroke portion to the first stroke portion, the center portion of the linkage is transferred from the complementary recess to the recess;

the first stroke portion of the razor head carrier is less than thirty percent of the total razor head carrier stroke;

the sliding mechanism comprises a locking mechanism which is adapted to selectively lock the razor head carrier relative to the housing and let the razor head carrier freely slide relative to the housing;

the locking mechanism is controlled by a release knob.

In addition, the embodiments of the present invention also relate to a razor comprising a handle as described above, and a razor head connected to the razor head carrier.

The following feature may be incorporated in such a razor:

the razor head is mounted onto the razor head carrier so that when the razor head carrier is in the first position, the razor head is completely located inside the housing behind the movable flap and when the razor head carrier is in the second position, the razor head is extending out of the razor handle.

The above and other objects and advantages of the embodiments of the present invention will become apparent from the detailed description of an embodiment of the present invention, considered in conjunction with the accompanying drawings.

In the various figures, the same references designate elements which are identical or similar.

Figure 1:
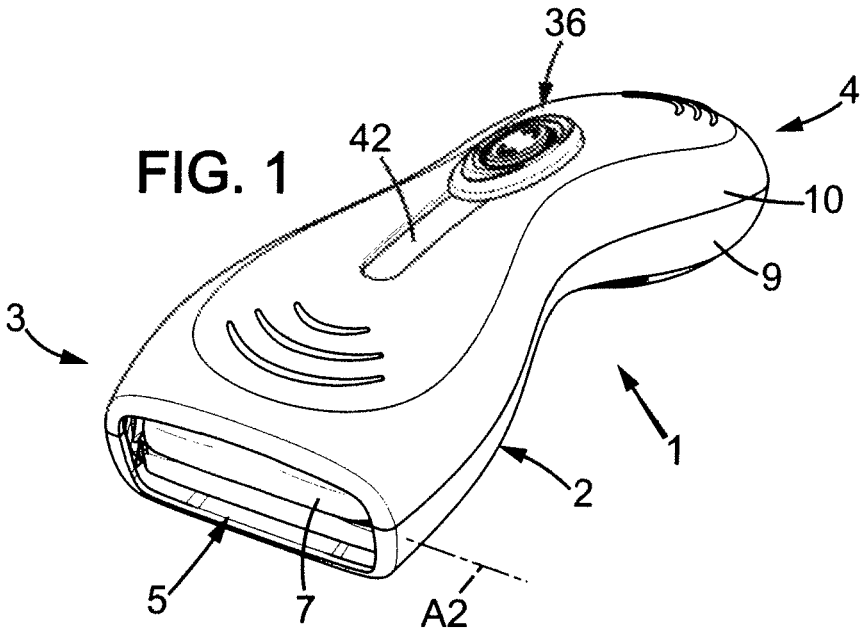
FIG. 1 is a perspective view of a razor handle according to an embodiment of the present invention, shown in the retracted position.

As illustrated in FIG. 1, the razor handle 1 according to an embodiment of the present invention comprises a front end 3 and an opposite back end 4. Such a razor handle 1 comprises a hollow housing 2 opened at the handle front end 3 by an opening 5. The housing 2 comprises a bottom shell member 9 and a top shell member 10.

The housing 2 can have a central constriction and can present in side view an arcuate shape, thereby providing comfortable hand grasping. In addition, gripping areas can also be provided on top and bottom sides of the handle 1 to improve the finger grasping.

Figure 2:
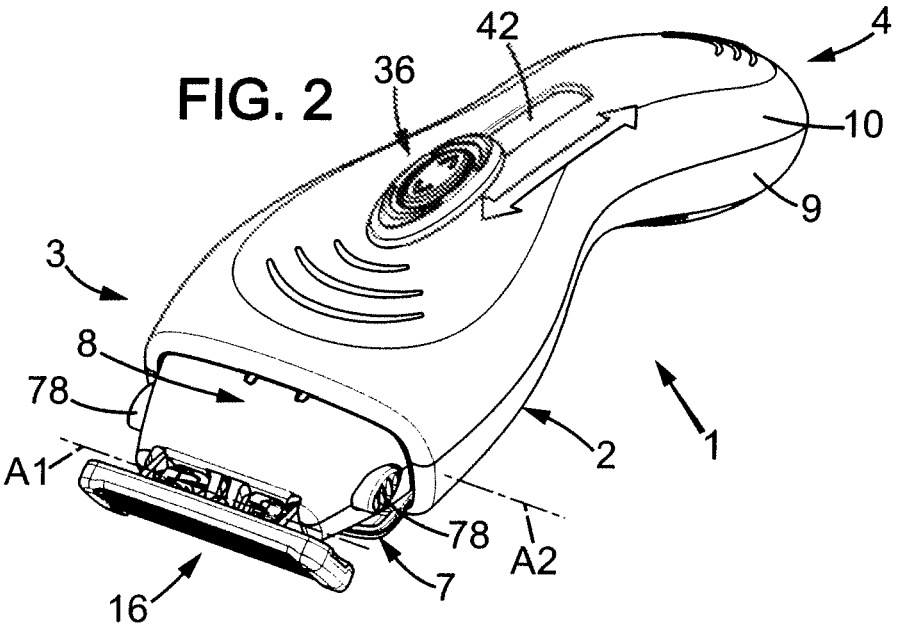
FIG. 2 is a perspective view of the razor handle of FIG. 1, shown in the extended position, with a razor head extending thereof.

The razor handle 1 comprises a razor head carrier 8, which is slidably mounted in the housing 2. Such razor head carrier 8 can be slidably moved between a first position and a second position. The first position, corresponding to the non-shaving position, is depicted in FIG. 1. The second position, corresponding to the shaving position, is depicted in FIG. 2.

Figure 8A:
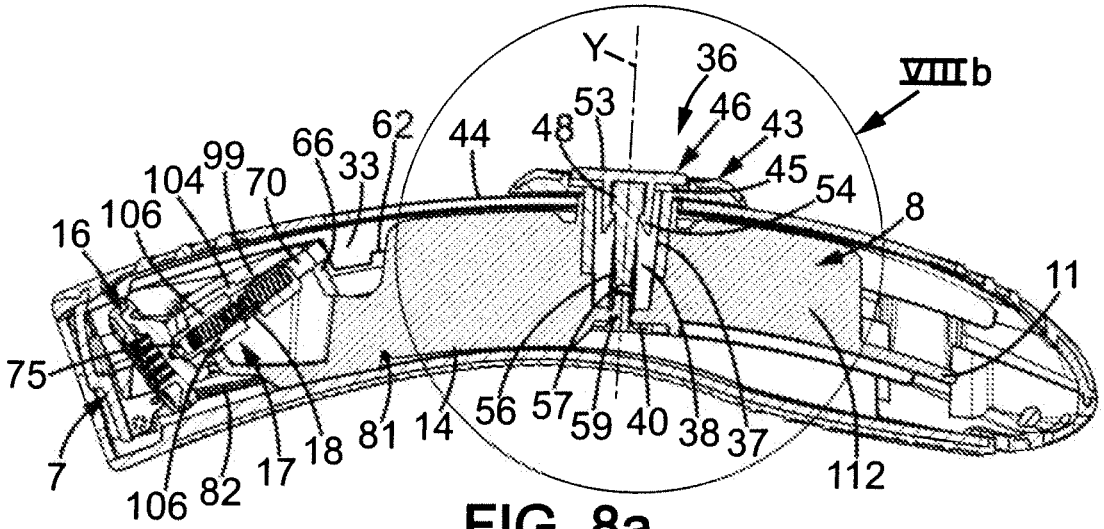
FIG. 8*a* is a longitudinal section of the razor of the preceding figures, taken along the line VIII-VIII of FIG. 6.

The razor handle 1 is able to carry a razor head 16, attached to the razor head carrier 8, the razor head including one or more blades (four in the illustrated example, as shown in FIG. 8*a*). The razor head attachment may allow a swiveling movement along an axis A1 parallel to the shaving cutting edge direction. Release members 78 are provided to unlock the razor head attachment and will be described in detail below.

The razor handle 1 further comprises a sliding mechanism 36 provided on the housing 2 for moving the razor head carrier 8 between the first position and the second position, along an aperture 42 provided on the top shell member 10.

In the first position, the razor head 16 carried by the razor head carrier 8 is retracted inside the housing 2, to prevent access from the user to the razor head. The razor head 16 is thus protected from damage and any accidental cutting is advantageously avoided.

Preferably the handle further comprises a movable flap 7 which can close the opening 5. In the first position, this flap covers the opening 5 to protect the razor head 16 against foreign object ingress, dust or moisture.

In the second position (FIG. 2), the razor head 16 carried by the razor head carrier 8 extends outside the handle to enable shaving. In this position, the movable flap 7 is open.

Figure 3:
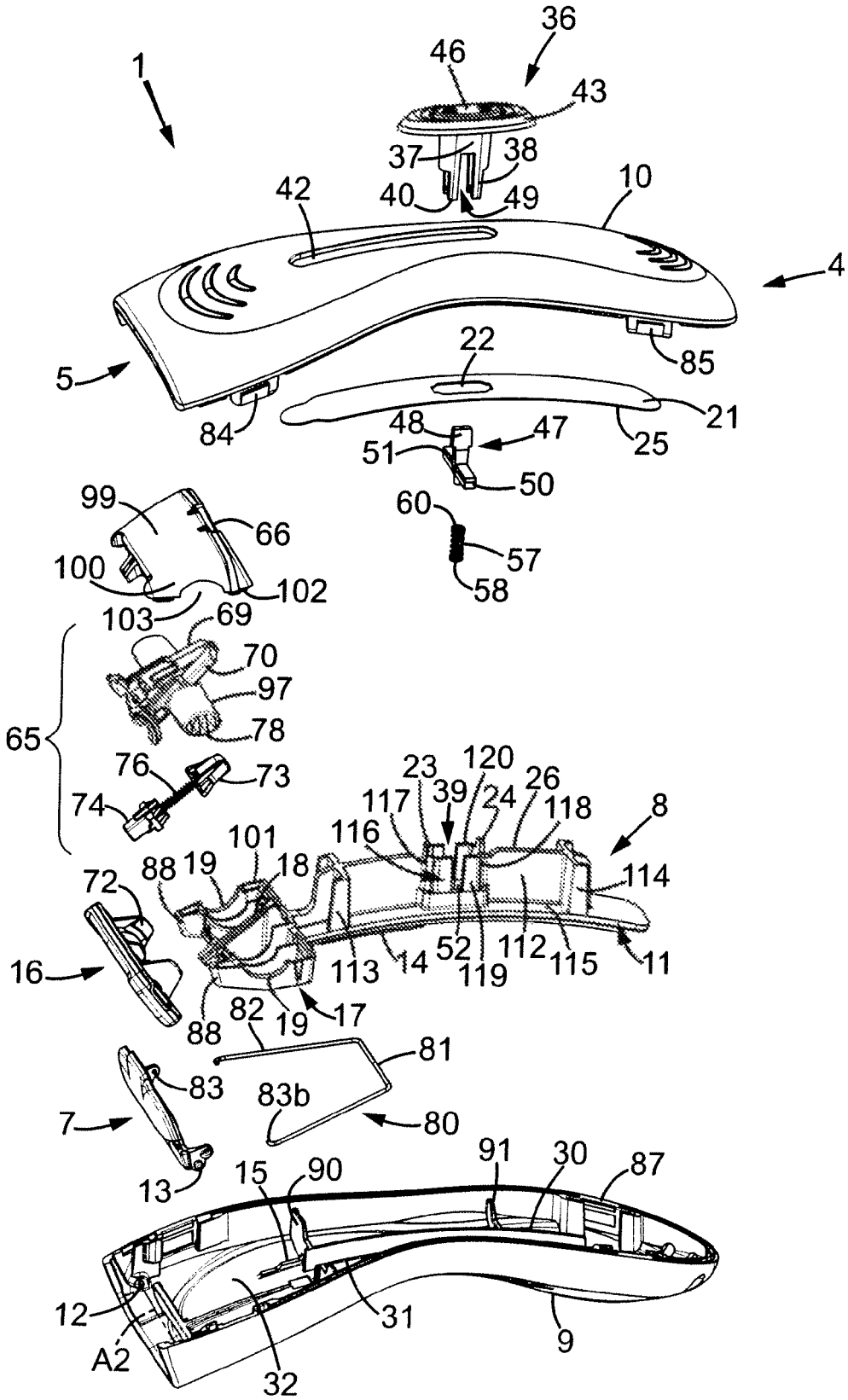
FIG. 3 is an exploded view of the razor handle of FIGS. 1 and 2, in the retracted position.
Figure 4:
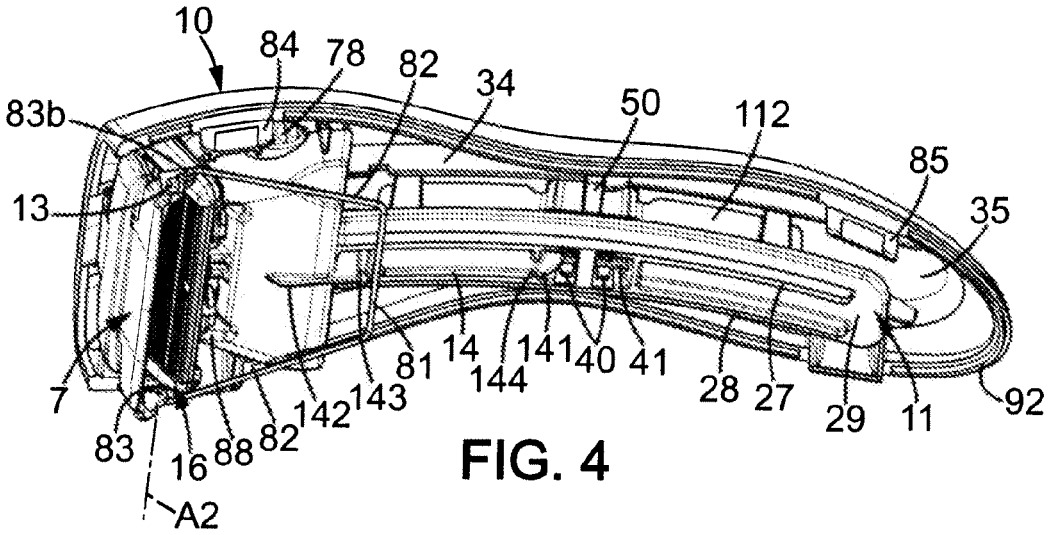
FIG. 4 is a partial perspective bottom view of the razor handle of the preceding figures, without the bottom shell member, shown in the retracted position.
Figure 5:
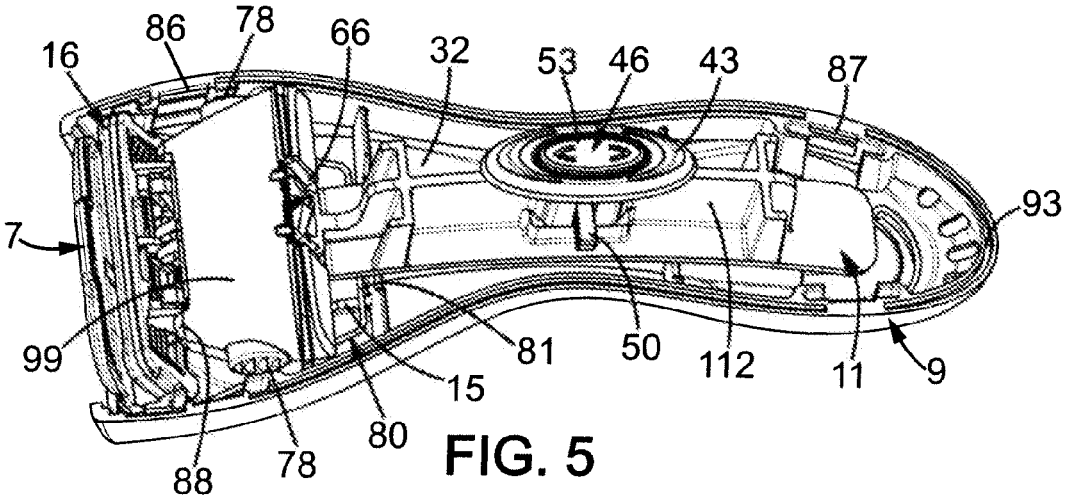
FIG. 5 is a partial perspective top view of the razor handle of the preceding figures, without the top shell member, shown in the retracted position.
Figure 6:
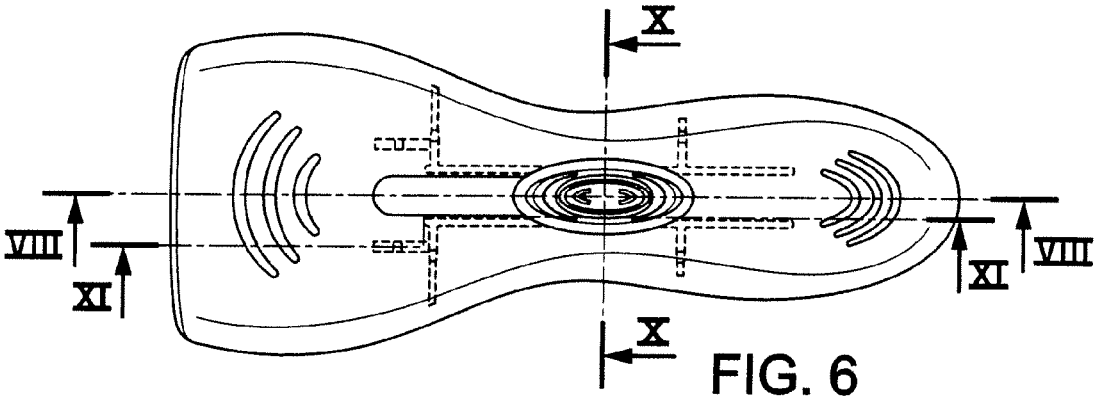
FIG. 6 is a top view of the razor handle of the preceding figures.

As illustrated on FIGS. 3, 4 and 5, the bottom shell member 9 and top shell member 10 are permanently attached to one another and together enclose the razor head carrier 8, by the means of flexible clip members 84, 85 located in the top shell member 10 clip. The clip members 84, 85 engage in corresponding opposite clip recesses 86, 87 located in the bottom shell member 9.

The razor head carrier 8 comprises an elongated arcuate plate member 11 which preferably has substantially the same curvature as that of the handle housing 2. The razor head carrier 8 comprises a longitudinal stiffening rib 112 and two spaced transversal ribs 113, 114 which protrude from a top surface 115 of the plate member 11. The razor head carrier 8 comprises also a hollow central housing 116 defined, on the one hand, by a pair of opposed transversal walls 117, 118 protruding from the top surface 115, and, on the other hand, by a pair of opposed longitudinal side walls 119, 120 also protruding from the top surface 115 in the continuity of the transversal walls 117, 118.

The front part of the razor head carrier 8 additionally comprises an attachment unit 17, protruding on the front end of the razor head carrier 8, whose purpose is to hold the lock-and-release mechanism together with the cover member 99, as this will be described in detail later.

The razor head carrier 8 may also comprises a control profile 14 extending from the lower surface 29 of the plate member 11, the control profile participating in the control of the movement of the linkage 80 as this will be described in detail later.

A flat arcuate guiding plate 21 is clipped onto the razor head carrier 8. More precisely, the guiding plate 21 is provided with a central hole 22, the edge of which cooperates with hooks 23, 24 protruding from the transversal walls 117, 118 of the plate member 11. The guiding plate 21 preferably has a bottom surface 25 in contact with a top edge 26 of the stiffening ribs 112, 113, 114, thereby providing stable mounting of the guiding plate 21 on the razor head carrier 8. The plate 21 slides together with the razor head carrier 8 and always masks the elongated aperture 42, thereby preventing access to the technical parts inside the handle 1.

As illustrated in FIG. 4, the razor head carrier 8 comprises a pair of parallel ribs 27, 28 protruding from a lower surface 29 of the razor head carrier 8, and which extend longitudinally substantially all along the length of the razor head carrier 8.

As depicted in FIG. 3, the handle 1 is provided with guiding means for the sliding of the razor head carrier 8, which comprise two parallel elongated bottom rails 30, 31 protruding from an inner bottom surface 32 of the bottom shell member 9, and extending along each lateral side of the pair of parallel ribs 27, 28.

The razor head carrier guiding means also comprise two parallel elongated top rails 33, 34 protruding from an inner top surface 35 of the top shell member 10 (also visible on FIG. 7), extending along lateral edges of the guiding plate 21.

The sliding mechanism 36 is slideable with respect to the top shell member 10 along a direction substantially parallel to the handle longitudinal axis, for moving the razor head carrier 8 from the first position to the second position and vice versa.

As illustrated on FIGS. 3, 5, 8*a* and 10, the sliding mechanism 36 is mounted on the razor head carrier 8 and comprises a guiding unit 43 having a cylindrical hollow body 37 which preferably has four projecting parallel flexible lugs 38 passing through a central aperture 39 defined in the razor head carrier 8 by the housing 116. The lugs 38 are provided with hooks 40 which engage in longitudinal bridge members 41 extending across the central aperture 39, so that the sliding mechanism 36 is clipped on the razor head carrier 8.

The body 37 of the guiding unit 43 passes through the aperture 42 which is formed in the top shell member 10 between the top rails 33, 34. The guiding unit 43 preferably has also a substantially flat head which projects, at one end of the body 37 opposite to the lugs 38, along a top external surface 44 of the top shell member 10.

The sliding mechanism 36 also comprises a locking mechanism having a release knob 46 and a pusher 47 which are slidingly mounted in the body 37 along an elevational axis Y. Pusher 47 preferably has a main body 48 mounted in a corresponding recess 49 formed in the body 37 of guiding unit 43, and diametrically opposed transversal arms 50, 51 which project laterally from the main body 48 and which are received in respective lateral slots 52 formed in the longitudinal side walls 119, 120 of the housing 116.

The guiding unit 43 top surface comprises a recess 45 to slidably receive this release knob 46.

The release knob 46 includes a cover member 53, which projects from the recess 45 to be accessible for a user's finger. The release knob 46 also includes legs which are projecting along axis Y and which are clipped onto the pusher 47 hooks 54 cooperating with corresponding shoulder surfaces 55 formed on the main body 48 of the pusher 47 (also visible on FIG. 8*b*).

Pusher 47 is slideable with respect to the body 37 along the elevational axis Y, between a locking position in which the pusher 47 is at a distance from the plate member 11, the release knob 46 projecting from the recess 45, and an unlocking position in which the pusher 47 is close to the plate member 11.

A return spring 57 is mounted in compression between the pusher 47 and the razor head carrier 8, so as to permanently bias the pusher 47 towards its locking position. More precisely, spring 57 preferably has a bottom end 58 which is mounted onto a pin 59 protruding from the plate 11, and a top end 60 which is mounted on a bottom pin 56 of the pusher 47, the pins 56, 59 thereby together forming spring guiding means.

As the return spring 57 biases continuously the pusher 47 against the release knob 46, the locking mechanism preferably has a locking position in which the knob 46 protrudes from recess 45, and an unlocking position in which the return spring 57 is compressed and in which the knob 46 is fully depressed into the recess 45.

Figure 7:
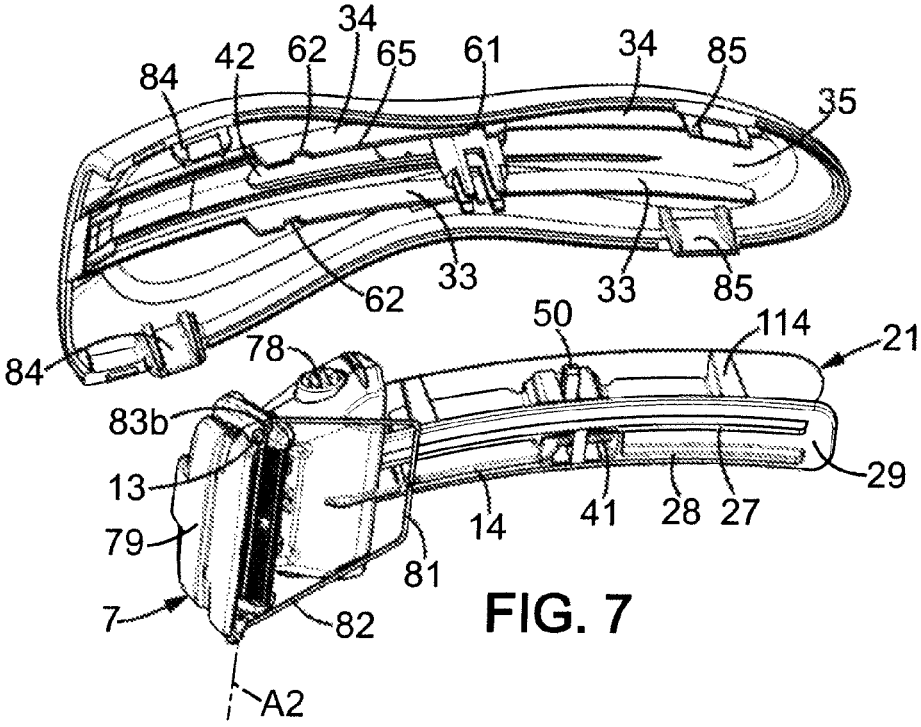
FIG. 7 is an exploded partial perspective bottom view of the razor handle, shown in the extended position.

As illustrated in FIG. 7, each top rail 33, 34 is provided with two spaced apart indents 61, 62, in which transversal arms 50, 51 are capable of being received, depending on the position of the sliding mechanism 36, i.e. a front end indent 62, located near the front end 3 of the handle, a back indent 61.

Figure 8B:
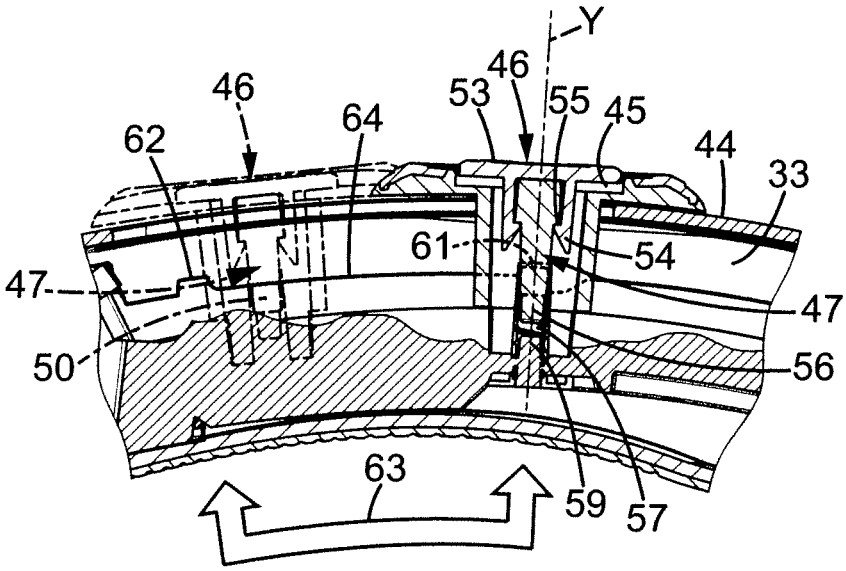
FIG. 8*b* is a detailed and zoomed longitudinal section of the razor of the preceding figures, taken along the line VIIIb of FIG. 8*a*.

As illustrated in FIG. 8*b*, in the first position of the razor head carrier 8, the arms 50, 51, which act as locking means for locking the razor head carrier 8 in position, are received in the back indents 61.

As the spring 57 biases the pusher 47 to its locking position, the arms 50, 51 abut longitudinally against transversal shoulder surfaces of the back indents 61, thereby preventing the razor head carrier 8 to move longitudinally.

Whenever the user wants to extend the razor head 16, he squeezes the release knob 46 against the action of the return spring 57, to unlock the locking mechanism, thereby releasing the arms 50, 51 of the pusher 47 from the back indent 61. The user is then capable of sliding the sliding mechanism 36 towards the front end 3 of the razor handle so to move the razor head carrier 8 towards the second position (FIG. 8*b*, chain dotted line). Accordingly, sliding mechanism 36 slides in intermediate positions with the release knob 46 and the pusher 47 in positions illustrated in chain dotted line. The pusher arm 50 slides along the bottom surface 64 of the top rails 33, 34. Thus the release knob 46 and pusher 47 move according to the arrow 63 shown on FIG. 8*b*.

During the movement of the razor head carrier 8 towards the second position, the razor head carrier 8 being precisely guided by the top and bottom rails 30, 31, 33, 34 as described above, the arms 50, 51 slide onto respective edges 64 of the top rails 33, 34, thereby holding the pusher 47 in its unlocking position, and holding the release knob 46 in its unlocking position.

As soon as the arms 50, 51 come in front e.g. of the front end indent 62, the spring moves the pusher 47 and the release knob towards their respective locking position, where the arms 50, 51 are clipped in the front end indents 62, thereby locking the razor head carrier 8 in its second position.

Accordingly, when the razor head carrier 8 is in first or second position, it is strongly held in position with respect to the housing 2, thereby preventing the razor head 16 from accidentally moving from one position to the other. Accordingly, there is low risk that a user cuts himself with the razor head.

In order to achieve replacement of the razor head 16, the razor handle 1 includes a lock-and-release mechanism 65. The lock-and-release mechanism 65 comprises at least one release member 78 provided on the razor head carrier 8. As depicted in FIG. 2, two release members 78 are provided respectively on each lateral face of the razor head carrier 8 to easily disengage the razor head 16 from the razor head carrier 8.

In the first position of the razor head carrier 8 as shown in FIG. 1, the release members 78 are hidden inside the housing 2, to prevent any access, especially from the fingers of a user. Thus, any inadvertent release of the razor head is prevented.

Conversely, in the second position of the razor head carrier 8 as shown in FIG. 2, the release members 78 are accessible to a user's fingers, thus enabling the release of the razor head 16.

To that extent, the razor head carrier 8 is adapted to carry the lock-and-release mechanism 65.

Figure 9:
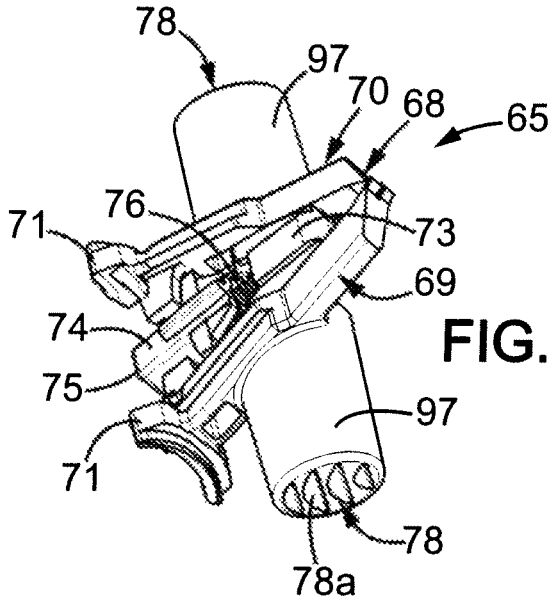
FIG. 9 is a top perspective view showing a lock-and-release mechanism for the razor of the preceding figures.
Figure 10:
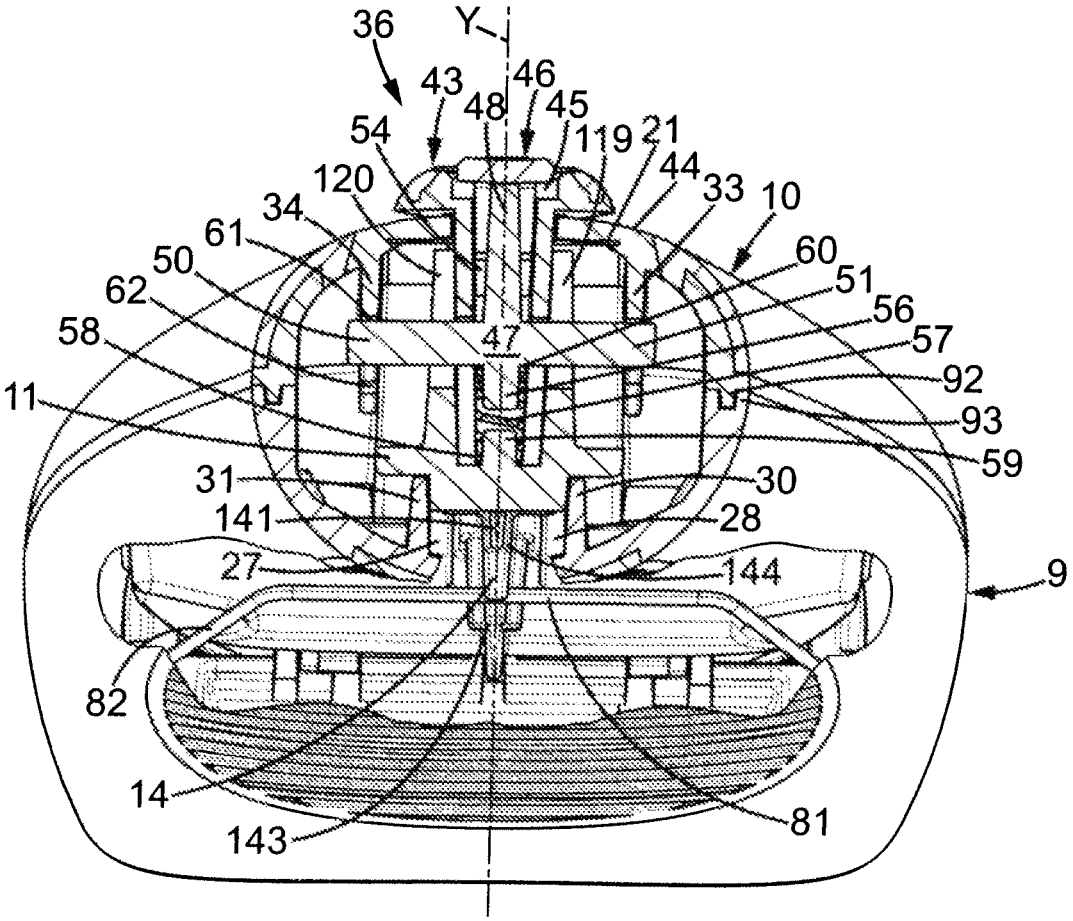
FIG. 10 is a transversal section of the razor of the preceding figures taken along the line X-X of FIG. 6, with a partial cutaway.

Referring to FIGS. 8*a* and 9, the lock-and-release mechanism 65 comprises, for example, a resilient V-shaped retainer 68 having two legs 69, 70 movable towards and away from each other. Bearing members 71 are formed at the ends of the legs 69, 70, removably attached to corresponding curved hooks 72 provided on the back side of the razor head 16 to permit swiveling movement of the razor head 16 with respect to the razor head carrier 8, around axis A1 (FIG. 2).

A cam member 73 is mounted between the legs 69, 70 for permanently biasing them away from each other in order to maintain the bearing members 71 in cooperation with the corresponding hooks 72. Between the legs 69, 70 is also mounted a plunger 74, a front portion 75 of which is in contact with a complementary cam surface provided on the back side of the razor head 16. A compression spring 76, interposed between the plunger 74 and the cam member 73, biases them away from each other, thereby pushing forward the plunger 74 to maintain permanent contact of the latter with the razor head 16, and pushing backwards the cam member 73 to maintain permanent contact of the latter with the legs 69, 70.

Each leg 69, 70 preferably has a respective protruding wing 97, which extends transversely from the respective leg 69, 70 to an opposite end, on which is located a release member 78. Preferably, each release member 78 preferably has an oval-shaped main body and comprises grip surfaces 78*a*.

As depicted on FIGS. 3 and 8*a*, the lock-and-release mechanism 65 is attached to the platform member 8 by means of an attachment unit 17 formed on the front end of the razor head carrier 8. A cover member 99, which is clipped onto the attachment unit 17, holds the lock-and-release mechanism 65. More precisely, the cover member 99 comprises lateral flanges 100 provided with hooks 102, which cooperate with corresponding retaining means 101 provided on the attachment unit 17. Cut-outs 103 are formed in the side walls of the cover member 99 for free passage of the wings 97.

The cover member 99 also comprises an opening 66 at the back side to receive the back edge of the V shape retainer 68.

A centerline longitudinal groove 18 is formed in the attachment unit 17 (visible on FIG. 3) and another opposite corresponding longitudinal groove 104 is formed in the cover member 99, those grooves cooperating with corresponding ribs 106 provided on the plunger 74 in order to guide forward and back movement of the plunger 74, and cam member 73.

Each lateral wing 97 is received between a concave shape 19, substantially semi ellipsoidal, in the attachment unit 17 and an opposite concave shape 103, substantially semi ellipsoidal, in the cover member 99. These two complementary shapes thus provide appropriate guidance in the transversal direction for each wing 97.

In the use position, wherein the razor head 16 protrudes from the handle 1, the movement of the release members 78 toward each other biases the wings 97, which bias in turn the legs 69, 70, thereby releasing the bearing members 71 from the razor head hooks 72, whereas forward movement of the plunger 74 under bias of the spring 76 ejects the razor head 16 and allows for disposal and replacement of the latter.

In addition, the bottom shell member 9 and top shell member 10 are assembled to each other. For example, an elongated pin 92 formed in the border of the top shell engages in a corresponding groove 93 formed in the border of the bottom shell (FIGS. 4 and 5). Top shell 10 and bottom shell 9 are permanently attached to one another by the means of clip members 84, 85 and clip recesses 86,87. In order to enhance the robustness of the housing 2, the bottom shell 9 additionally comprises two transversal stiffening ribs 90, 91 (FIG. 3) extending from the bottom surface 32 transversally up to the sides of the bottom shell 9.

The attachment unit 17 further comprises two lateral protrusions 88 extending from the front ends of the attachment unit 17 in the direction of the razor head 16. These protrusions 88 act as a guidance means when coupling the razor head 16 onto the razor handle 1 and form a protection frame for the bearing members 71 and the razor head hooks 72 against mechanical external stress or shocks.

According to an embodiment of the present invention, the razor handle 1 can further comprise a cover member. Such cover member is for example a movable flap 7 pivotally mounted on the front end 3 of the razor handle 1, between two positions:

a closed position in which the flap 7 covers the opening 5 of the housing 2 of the handle (FIGS. 1, 4, 5, 8*a*, 11*a*), to prevent access to the blades and protect the inside of the handle (in particular against dust and moisture), and the razor head 16, and an open position in which the flap 7 uncovers the opening 5 (FIGS. 2, 11*d*) to allow the razor head carrier 8 to slide out and project outward the razor head 16.

Referring specially to FIGS. 7 and 11*a*-11*d*, the flap 7 comprises a substantially flat member 79, whose surface substantially corresponds to the surface of the opening 5 of the housing 2 (see FIG. 8*a*). The flap 7 comprises additionally two smaller diametrically opposed lateral flanges 79*b*.

The flap 7 comprises an articulation mechanism enabling the swiveling around the transversal axis A2, perpendicular to the main elongation axis of the razor handle 1. As depicted on FIGS. 3 and 8*a*, in order to be able to swivel, the flap is pivotally fixed on the handle by two pins 13 engaged in axis recesses 12, formed in the side of the bottom shell member 9.

The flap further comprises two symmetrically opposed holes 83, located in the lateral flanges 79*b* to receive control means for controlling the movement of the flap 7.

These control means comprise a linkage 80 controlled by the razor head carrier 8.

The linkage 80 comprises for example an elongated U-shaped resilient wire having a center portion 81 and two symmetrically extending arms 82, each arm having a free end 83*b* received in holes 83. As described hereafter, the linkage 80 is attached on the handle 1 in a way allowing the opening and closing of the flap 7 accordingly with the sliding of the razor head carrier 8.

The razor head carrier 8 comprises a control profile 14 located under the surface 29 of the plate member 21. This control profile 14 extends perpendicularly from the center line of this surface 29, between the two guiding ribs 27,28. As depicted in FIGS. 10 and 11*a*-11*d*, the thickness of this profile is substantially constant from the back end 141 to the front end 142. Transversal spaced apart stiffening ribs 143,144 enhance the rigidity of the control profile 14.

This control profile 14 comprises a recess 140, close to the back end 141, the recess having a stop face 140*b* and a slope wall 140*a*, cooperating with the center portion 81 of the linkage 80.

In addition, the housing comprises in the bottom shell member 9 two symmetrical complementary control profiles 15, shown in FIGS. 3, 5 and 11*a*-11*d*, having a recess 150 comprising a slide portion 15*a* and a ramp 15*b*.

The center portion 81 is sandwiched between the control profile 14 and the complementary control profiles 15 as depicted particularly in FIGS. 11*a* to 11*d*.

Figure 11A:
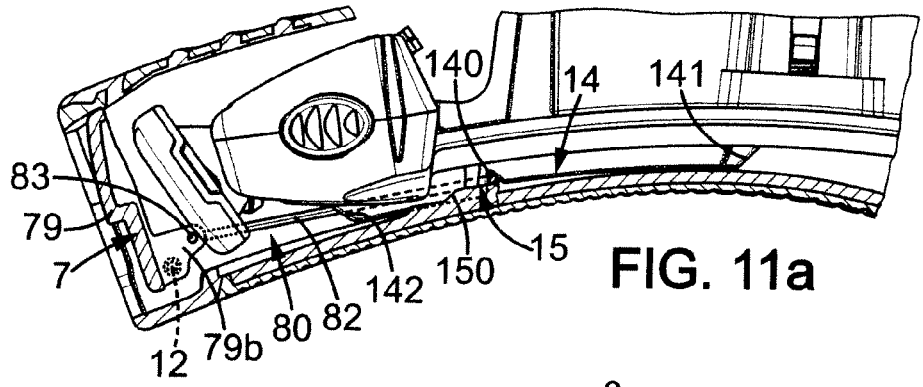
FIGS. 11*a* to 11*d* are schematic partial views showing the kinematics of the linkage controlling the flap, FIG. 11*a* corresponding to the first position, FIG. 11*d* to the second position and FIGS. 11*b* and 11*c* to intermediate positions.
Figure 11B:
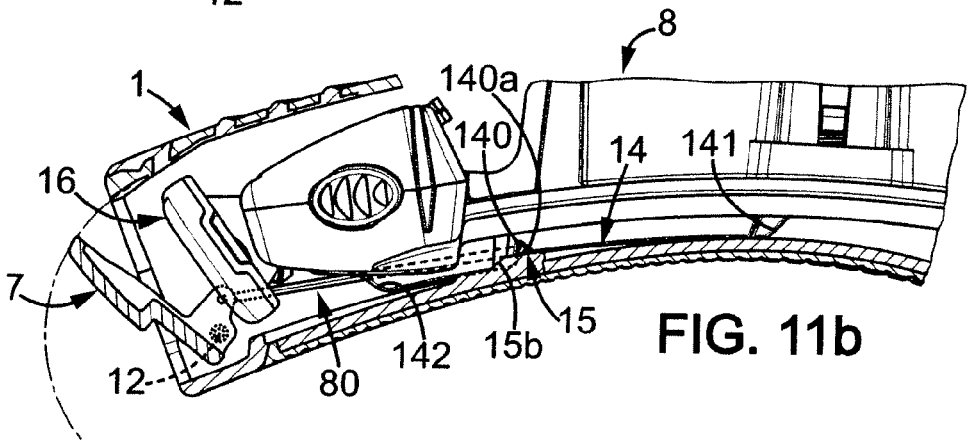
Figure 11C:
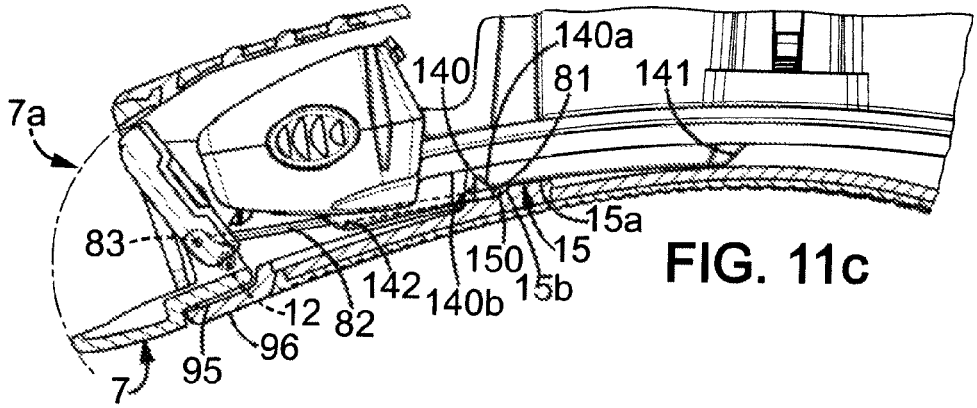
Figure 11D:
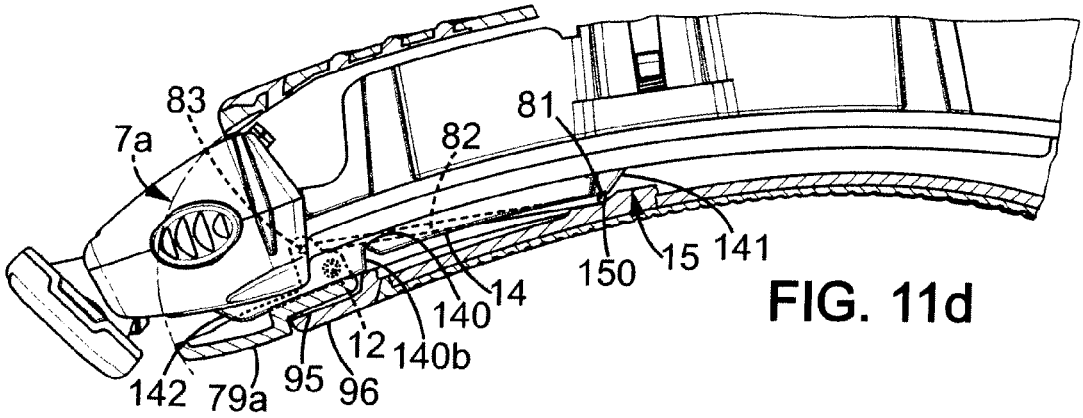
Figure 12:
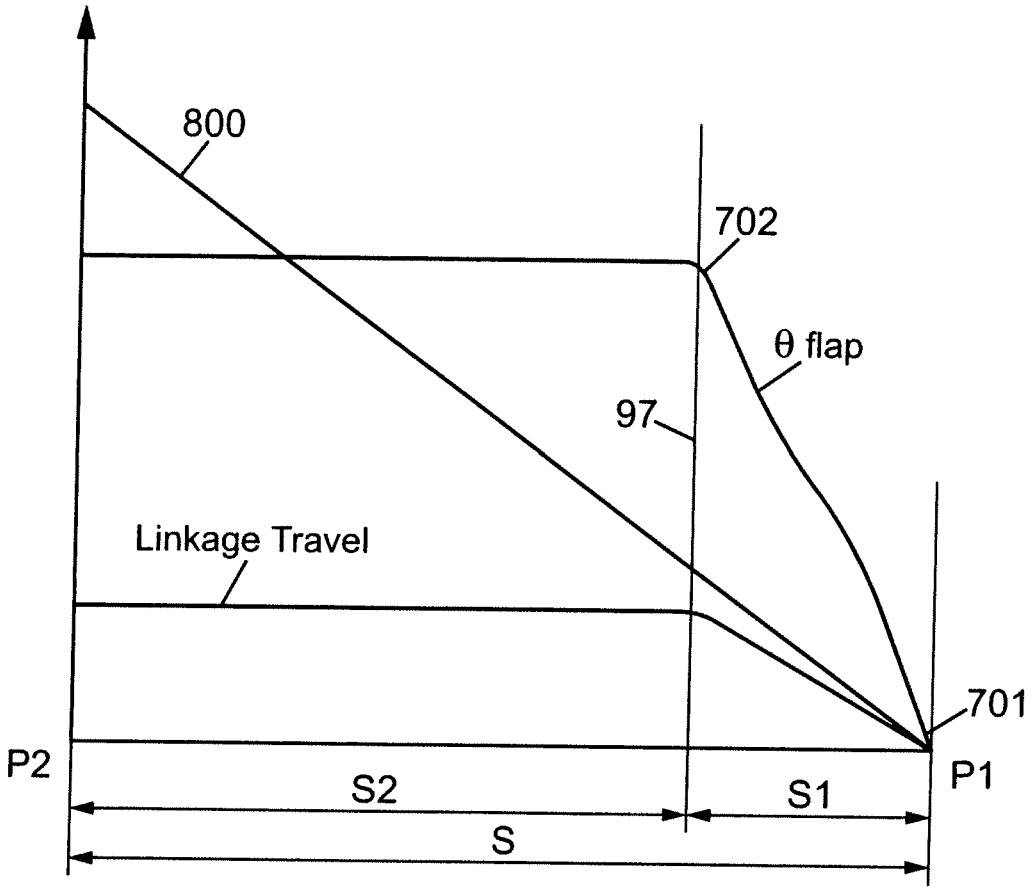
FIG. 12 is a diagram showing the relationship between the razor head carrier stroke, the linkage travel and the flap angular displacement.

The movement of the razor head carrier 8, illustrated in FIG. 11*a*-11*d*, defines a movement stroke S illustrated in FIG. 12, comprising a first stroke portion S1 in which the control profile 14 pushes or pulls the center portion 81 of the linkage 80, and a second stroke portion S2 in which the linkage 80 is not moving and is located in the recess 150 of the complementary control profiles 15 (FIGS. 11*c*, 11*d*).

When the sliding mechanism 36 moves from the first to the second position of the razor head carrier 8, as illustrated in FIG. 11*b*, the control profile recess 140 pushes the linkage 80 towards the front end 3 of the razor handle 1, at least in the first part S1 of the stroke (FIGS. 11*a* and 11*b*), the center portion 81 of the linkage being retained in the recess 140 by the slide portion 15*a* of the complementary control profile 15.

Conversely, when the sliding mechanism moves back from the second to the first position of the razor head carrier 8, the control profile recess 140 pulls the linkage 80 towards the back end 4 of the razor handle 1, at least in the first part S1 of the stroke (FIGS. 11*a* and 11*b*), the center portion 81 of the linkage being retained in the recess 140 by the slide portion 15*a* of the complementary control profile 15.

As illustrated in FIG. 12, this first stroke portion S1 of the razor head carrier 8 is less than thirty percent of the total razor head carrier stroke S. This first stroke portion S1 corresponds to the opening and closing of the movable flap 7 (shown as dotted line 7*a* on FIG. 11*c*-11*d*), while the displacement of the razor head carrier 8 is relatively small. As a result, the razor head 16 does not touch the movable flap 7 during this part of the stroke. In other words, the movable flap 7 opens before the razor head 16 moves out of the opening 5, which prevents any damage on the razor head 16 or on the cutting blades themselves.

In the second portion S2 of the stroke, between the positions shown in FIGS. 11*c* and 11*d*, the center portion 81 of the linkage 80 remains in the recess 150 and the control profile 14 slides on it without pushing or pulling it. As the center portion 81 does not move relative to bottom shell 9, the movable flap 7 remains in the same position, i.e. fully open. In this position, the flap member 79 is nearly in contact with the inner surface 95 of the bottom shell member 9, in line with the bottom shell, the flap surface 79*a* being flush with the bottom shell surface 96. This inner surface 95 constitutes a travel stop for the flap and the linkage travels.

Along the first stroke portion S1, the recess 140 receives the center portion 81 of the linkage and moves the center portion 81 of the linkage along the complementary control profile 15. Along the second stroke portion S2, the complementary recess 150 receives the center portion 81 of the linkage, while the control profile 14 slides and urges the center portion 81 of the linkage in the complementary recess 150.

When the razor head carrier 8 is moved from the first stroke portion S1 to the second stroke portion S2, the center portion 81 of the linkage is released from the recess 140 and urged into the complementary recess 150 by the slope wall 140*a*. When the razor head carrier 8 is moved from the second stroke portion S2 to the first stroke portion S1, the center portion 81 of the linkage is moved by the stop face 140*b* along the ramp 15*b* from the complementary recess 150 to the recess 140.

Returning to FIG. 12, the razor head carrier 8 stroke S presents a rather linear displacement 800 from the first position P1 to the second position P2. This displacement 800 is also the displacement of the moving control profile 14 for the linkage 80.

In the first stroke portion S1, the linkage travel is proportional to the razor head carrier displacement 800. The angular displacement of the movable flap (θ flap) is directly linked to the linkage travel through the hinge 12, 13 and the articulation control 83,83*b*: the flap angularly moves from the closed position 701 to the open position 702 (corresponding to FIG. 11*c*).

In the second stroke portion S2, the linkage travel and the flap angular position (θ flap) correspond to the open position of the flap (as shown in FIG. 11*c*). In this portion the razor head carrier 8 can move to its second position P2 without any mechanical contact between the razor head 16 and the flap 7. When moving back from the second position P2 towards the first direction, the razor head carrier 8 retracts all along the second stroke portion S2, without any movement on the linkage 80 or on the flap 7 until it reaches the first stroke section, shown by reference 97. At this point the razor head 16 is nearly completely retracted.

When the retraction movement goes on towards the position P1, the linkage travel decreases from 702 towards 701 together with the related flap angular position (θ flap). As a result, all along the stroke S, no contact occurs between the movable flap 7 and the razor head 16.

The invention claimed is:

1. A razor handle comprising:

a hollow elongate housing having a front end and a back end opposite to the front end, the housing further comprising an opening provided at the front end, a razor head carrier which is slidably mounted in the housing between:

a first, non-shaving position in which the razor head carrier is retracted inside the housing, and a second, shaving position in which the razor head carrier is extended towards the opening of the housing, a sliding mechanism provided on the housing for moving the razor head carrier between the first position and the second position, and a single movable flap movably mounted between a closed position in which the flap closes the opening, and an open position in which the opening is open, wherein the movable flap is driven back and forth by the razor head carrier between the closed and open positions, so that the movable flap is in the closed position when the razor head carrier is in the first position and the movable flap is in the open position when the razor head carrier is in the second position, wherein the movable flap is pivotally mounted around a swiveling axis, and the razor handle further comprises a single-part linkage controlling the movable flap and the linkage being controlled by the razor head carrier, wherein the linkage is movable with the razor head carrier and is attached with a pivot connection to the movable flap, wherein the razor head carrier comprises a control profile, and wherein the housing comprises at least one complementary control profile, the control profile and the complementary control profile cooperating with the linkage by pushing and pulling the linkage, wherein the control profile comprises a recess having a stop face and the complementary control profile comprises a slide portion and a complementary recess having a ramp, the razor head carrier being able to slide along a stroke, comprising at least a first stroke portion in which the center portion of the linkage is located in the recess and driven by the razor head carrier along the slide portion, and a second stroke portion in which the center portion of the linkage is located in the complementary recess and is not moving relative to the housing, while the razor head carrier is sliding.

2. The razor handle according to claim 1, wherein the housing has at least two recesses defining the swiveling axis, and the movable flap has at least two protruding pins received respectively in the recesses.

3. The razor handle according to claim 2, wherein the linkage comprises an elongated U-shaped wire having a center portion and at least two lateral arms, the movable flap having at least two symmetrically opposed holes receiving the respective ends of the arms.

4. The razor handle according to claim 1, wherein when the razor head carrier is moved from the first stroke portion to the second stroke portion, the center portion of the linkage is released from the recess in the complementary recess, and wherein when the razor head carrier is moved from the second stroke portion to the first stroke portion, the center portion of the linkage is moved by the stop face along the ramp from the complementary recess to the recess.

5. The razor handle according to claim 1, wherein the first stroke portion of the razor head carrier is less than thirty percent of the total razor head carrier stroke.

6. The razor handle according to claim 1, wherein the sliding mechanism comprises a locking mechanism adapted to selectively lock the razor head carrier relative to the housing and let the razor head carrier freely slide relative to the housing.

7. The razor handle according to claim 6, wherein the locking mechanism is controlled by a release knob.

8. The razor handle according to claim 1, further comprising a razor head attachment unit, having lateral protrusions extending from the attachment unit.

9. A razor comprising a handle according to claim 1, and a razor head connected to the razor head carrier.

10. The razor according to claim 9, wherein the razor head is mounted on the razor head carrier so that when the razor head carrier is in the first position, the razor head is completely located inside the housing behind the movable flap, and when the razor head carrier is in the second position, the razor head extends outside the razor handle.

11. The razor according to claim 9, wherein the razor head comprises hooks, and wherein the razor handle comprises a razor head attachment unit, having lateral protrusions extending from the attachment unit, the lateral protrusions partially covering the razor head hooks.

* * * * *